US009422674B2

(12) United States Patent
Battisti et al.

(10) Patent No.: US 9,422,674 B2
(45) Date of Patent: Aug. 23, 2016

(54) IN-TRACK RAIL WELDING SYSTEM

(75) Inventors: Charles R. Battisti, Gladstone, MO (US); Gary Barnhart, Roeland Park, KS (US)

(73) Assignee: Chemetron-Railway Products, Inc., Albertville, AL (US)

( * ) Notice: Subject to any disclaimer, the term of this patent is extended or adjusted under 35 U.S.C. 154(b) by 2534 days.

(21) Appl. No.: 12/173,672

(22) Filed: Jul. 15, 2008

(65) Prior Publication Data

US 2009/0229486 A1 Sep. 17, 2009

Related U.S. Application Data

(60) Provisional application No. 61/035,997, filed on Mar. 12, 2008.

(51) Int. Cl.
*E01B 29/46* (2006.01)

(52) U.S. Cl.
CPC ..... *E01B 29/46* (2013.01)

(58) Field of Classification Search
CPC ..... E01B 29/46
See application file for complete search history.

(56) References Cited

U.S. PATENT DOCUMENTS 3,595,463 A * 7/1971 Fadeev et al. ..... 228/44.3
3,982,091 A * 9/1976 Zollinger ..... 219/101
4,313,382 A * 2/1982 Bommart ..... 104/307
4,319,118 A * 3/1982 Chason ..... 219/118
4,410,780 A * 10/1983 Mutti ..... 219/53
4,645,897 A * 2/1987 Gourlay et al. ..... 219/101
4,983,801 A * 1/1991 Theurer et al. ..... 219/54
5,270,514 A 12/1993 Wechselberger
5,511,484 A * 4/1996 Theurer et al. ..... 104/2
6,033,166 A * 3/2000 Hampel ..... 409/175
6,163,003 A 12/2000 Battisti
6,396,020 B1 * 5/2002 Thelen et al. ..... 219/54
6,637,340 B1 * 10/2003 Wilson ..... 104/2
6,637,727 B1 * 10/2003 Decker et al. ..... 254/228
6,886,470 B2 * 5/2005 Norby et al. ..... 104/15
7,470,871 B2 * 12/2008 Theurer et al. ..... 219/53
7,478,596 B2 * 1/2009 Theurer ..... 104/2
7,523,707 B2 * 4/2009 Theurer et al. ..... 104/15
7,868,269 B2 * 1/2011 Silvestro ..... 219/133
2006/0261044 A1 11/2006 Theurer et al.

OTHER PUBLICATIONS

United States Patent and Trademark Office, International Search Report in International Patent Application No. PCT/US2008/061796 (Aug. 7, 2008).

* cited by examiner

*Primary Examiner* — David Angwin
*Assistant Examiner* — Amit K Singh
(74) *Attorney, Agent, or Firm* — Leydig, Voit & Mayer, Ltd.

(57) ABSTRACT

An improved in-track welder eliminates conduction path force members and employs separate bridging current path conductors for DC welding of rail ends. The enhancement allows for an increased closure distance, thus improving cold-weather operations. An increased allowable distance between conduction contacts allows for the incorporation of an internal shear member for more efficient finishing of welds. The force members may be optimized for strength rather than electrical properties, and are comprised of relatively small diameter alloy steel rods.

20 Claims, 10 Drawing Sheets

IN-TRACK RAIL WELDING SYSTEM

This patent application claims priority to U.S. provisional patent application Ser. No. 61/035,997 filed on Mar. 12, 2008.

TECHNICAL FIELD

This disclosure relates generally to systems and methods for flash butt welding of rail way rails and, more particularly, to an in-track DC welding system for executing flash butt welding.

BACKGROUND

Resistance welding of railroad rails is often used to join two rail sections together as a rail way is built or repaired. This type of welding is commonly referred to as "flash butt" welding. Flash butt welding is distinguished from conventional pot welding where a filler material is flowed into the weld joint.

Pot welding, which is based on adding filler material to a metal joint, can be viewed as a form of casting. During a pot weld, liquid metal is used as a filler material. As the filler material later transforms from liquid to solid metal during cooling of the weld, the filler material, which is typically steel, shrinks several percent, drawing material from the risers on either side of the base and from above the head. Voids from this shrinkage, as well as sand inclusions from the mold and oxide inclusions from splashing, tend to reduce the strength and life of the weld.

These problems are largely solved by flash butt welding. During flash butt welding, the two rails ends to be joined are first heated and then forged together, expelling liquid and oxides from the weld joint. The forged joint is sheared to remove the flash, which is solidified material that was forced out of the joint during forging.

As noted above, a typical flash butt weld requires two operations: (1) closing a gap in the track, and (2) heating the joint to forge the rail ends. Existing in-track weld heads have insufficient power and stroke length to execute large gap/large force closures without employing additional equipment in conjunction with the head. In particular, for example, the execution of a closure weld when a large amount of force is required to pull the rails together is performed with a separate pull assistance device working in conjunction with the welding head. During this type of operation, the pull force, timing and alignment of each device has to be coordinated in a complex and time consuming manner that requires extensive operator skill and oversight.

When considering this background section, the disclosure and claims herein should not be limited by the deficiencies of the prior art. In other words, the solution of those deficiencies is not a critical limitation of any claim unless otherwise expressly noted in that claim. Moreover, while this background section is presented as a convenience to the reader who may not be of skill in this art, it will be appreciated that this section is too brief to attempt to accurately and completely survey the prior art. The preceding background description is thus a simplified and anecdotal narrative and is not intended to replace printed references in the art. To the extent an inconsistency or omission between the demonstrated state of the printed art and the foregoing narrative exists, the foregoing narrative is not intended to cure such inconsistency or omission. Rather, applicants would defer to the demonstrated state of the printed art.

SUMMARY

In one aspect, an improved in-track weld system is provided for forge welding of rail segments together in place on a rail way. In an embodiment, the improved in-track weld system comprises at least two clamping assemblies, each comprising at least two clamp arms and a hydraulic actuator, such that a first clamping assembly may be clamped to a first rail segment and a second clamping assembly may be clamped to a second rail segment. The an improved in-track weld system further comprises at least two force members linking the first clamping assembly and the second clamping assembly, wherein the force members are operable to force the first rail segment and the second rail segment together. A weld circuit separate from the force members applies a DC power differential across the first rail segment and the second rail segment, such that when the first rail segment and the second rail segment are brought into contact the weld circuit is closed, resulting in resistive heating of ends of the first rail segment and the second rail segment at a weld joint so that the ends may be forged together under force applied by the force members.

DETAILED DESCRIPTION

Figure 1:
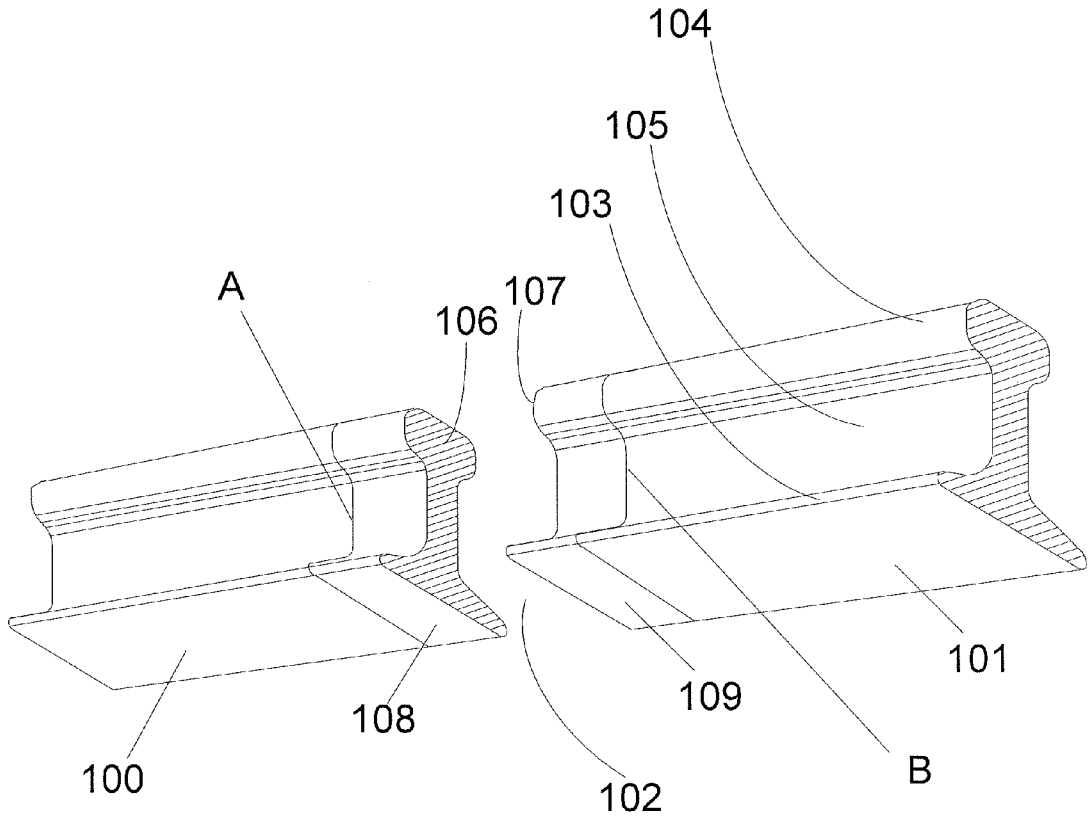
FIG. 1 is a perspective view of two rail segments in position for flash butt welding in accordance with the disclosed principles.

Before describing the disclosed implementations in detail, a brief description of the rail welding environment will be undertaken to aid the reader. Railroad tracks are comprised of steel that is subject to expansion and contraction as the ambient temperature rises and falls. Because railroad tracks are often quite long, a small percentage of expansion or contraction can result in a free rail length that varies substantially with temperature. However, railroad tracks are generally fixed and cannot undergo sizeable dimensional changes. Instead, the tension and compression forces in the tracks change with temperature and may become substantial. Excess tension forces can cause track separations, while excess compression forces can cause track buckling.

To counteract the effects of temperature-dependence, the tracks are installed such that at a predetermined zero-stress temperature, which may differ from the current ambient temperature, the track will be in equilibrium, with no tension or compression. Because the ambient temperature during installation is often less than the zero-stress temperature, the track will be somewhat contracted and will need to be pulled together, sometimes quite substantially, during the welding process. This problem can be exacerbated by other causes as well. For example, a segment of track may be "hung-up" on another component of the rail system and may need to be pulled free.

Thus, whatever the cause of the gap, tracks must often be pulled together with substantial force to contact the ends and accomplish a weld. This type of operation is known as a closure weld. The two parameters that generally affect a closure weld are stroke and closure force. The stroke is the distance the rail ends can be moved toward one another in order to close the gap and to effect a butt weld, and the closure force is the force that is available to overcome track tension or hang-ups and push the ends of the track together during the weld. The amount of force applied while the ends are in contact is sometimes referred to as the forging force.

The system described herein provides an increased stroke over known systems while at the same time providing increased closure/forging force, thus improving cold-weather operations and other operations in which increased stroke and/or force are required. The described system provides these advantages by employing DC rather than AC welding current. The use of DC current eliminates inductance losses that are present in AC systems. In particular, electrical impedance is generally thought of as including resistive, capacitive, and inductive components. In the present environment, the capacitive component is negligible. More importantly, however, is the inductive component, which is substantial in the case of AC power, but is essentially nonexistent in the case of DC power.

Eliminating the inductive impedance component allows longer current paths and smaller conductors to be used without incurring parasitic inductance losses. Thus, instead of using the force members themselves as conductors, as must be done in AC systems, separate longer conductors with smaller cross-sectional areas can now be used. Moreover, these conductors are made of highly conductive material that need not be optimized for physical strength. Conversely, the force members are now made of a very strong steel that need not be optimized for electrical conductivity.

These improvements in materials and configuration lead to substantial improvements in performance and capabilities. For example, since the force members are optimized for strength and not electrical conductivity, they are smaller and yet can still be as strong as or stronger than prior systems. Their decreased size allows the weld head to clamp lower on the rail, at an optimal central location. Moreover, since the current path length is no longer critical and the force members are of improved strength, the stroke of the machine can be much longer than prior systems. Moreover, the greater acceptable distance between contacts allows for the inclusion in the head of an internal shear to simplify the welding operation.

Turning to the specifics of rail welding, FIG. 1 is a perspective view of two rail segments in position for flash butt welding in accordance with the disclosure. In particular, a first rail segment 100 and a second rail segment 101 are shown aligned with one another with a slight space 102 between the first rail segment 100 and the second rail segment 101. Each of the first rail segment 100 and the second rail segment 101 include a rail base section 103 as well as a rail head section 104. The rail base section 103 and the rail head section 104 are interconnected via a rail web section 105. The rail base section 103 and the rail web section 105 provide strength to the rail generally and also provide surface area for joints between rail segments such as between the first rail segment 100 and the second rail segment 101. The rail head section 104 provides additional strength to the rail and provides additional surface area for joining, but also provides a support plane upon which rail wheels will run when the rail way is completed.

It is often necessary to perform in-track joining of rail segments. For example, large rail segments created during in-plant welding may be transported to a rail way location and joined in series to create a finished rail way. Moreover, individual rail segments may be joined at the rail way location in combination with or instead of longer pre-welded segments. Finally, in-track welding is also used to repair or modify existing rail ways. In-track welding is welding that is performed at the rail way site, often by a machine that rides on the rails. Such a machine may be a rail-only machine, but is more typically a machine adapted to ride on both roadways and rail ways via the use of two different wheel sets.

In-track welding in accordance with the disclosed structure is performed via resistive heating of rail ends to allow the ends to be forged together under force. In the illustration of FIG. 1, the first rail segment 100 has a first rail end 106, and the second rail segment 101 has a second rail end 107 (obscured in perspective view by second rail segment 101). During in-track welding, a region at the end of each rail of interest is heated. In the illustrated example, a first region 108 adjacent first rail end 106, delineated by line A, is heated, as is a second region 109 adjacent second rail end 107, delineated by line B. The longitudinal extent of the first region 108 and the second region 109 are exaggerated in FIG. 1 for clarity.

Figure 2:
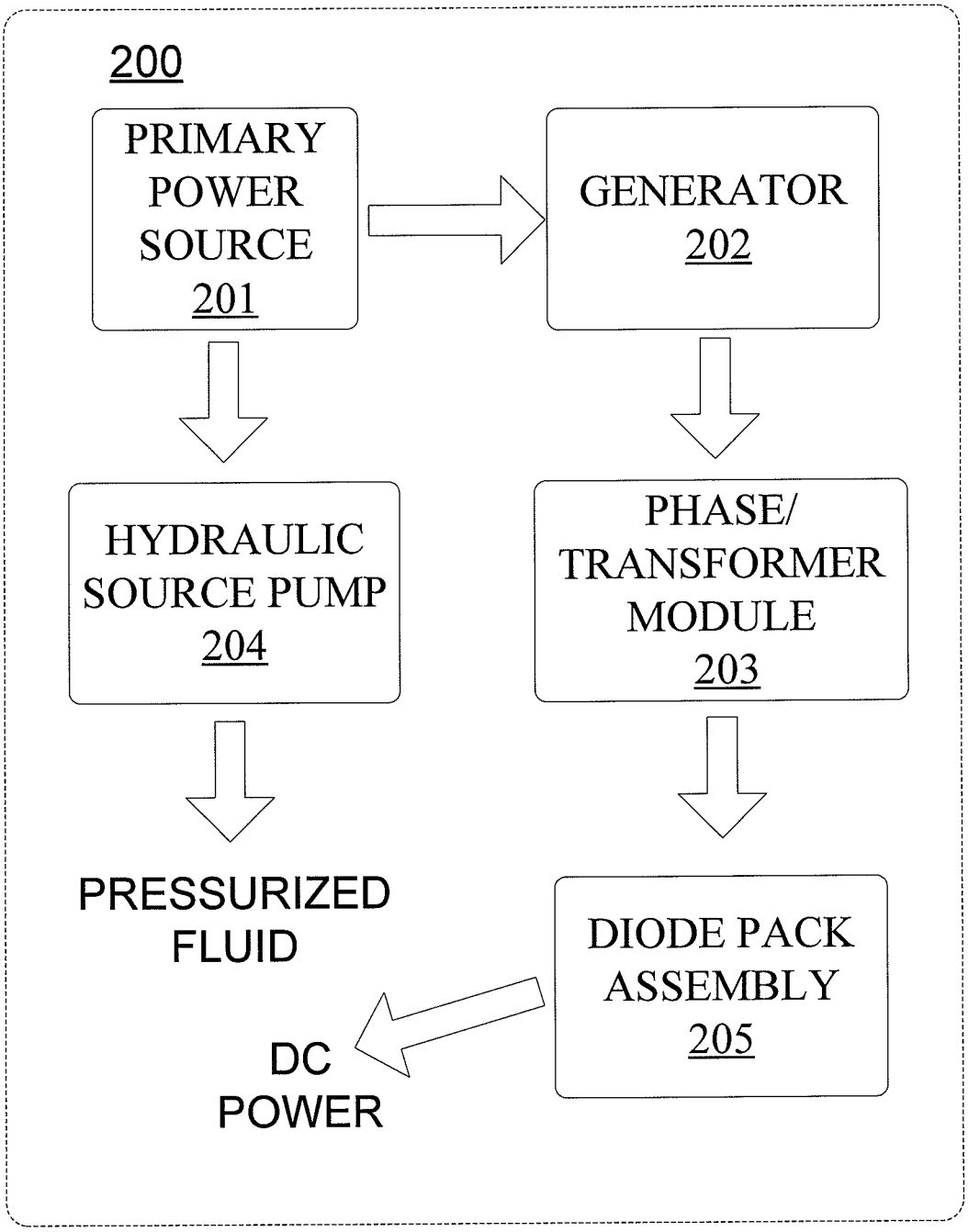
FIG. 2 is a schematic electrical view of an in-track welding system in accordance with the disclosed principles.

Prior to discussing the structure of the in-track welding system in accordance with the disclosure, the welding procedure will be briefly discussed to aid the reader's later understanding of the unique structural elements. In conjunction with this discussion, reference is made to FIG. 2, which shows a schematic view of an in-track welding energizing system 200 in accordance with the disclosure. The in-track welding energizing system 200 comprises electrical energy generation and transformation elements. In particular, the in-track welding energizing system 200 includes a primary power source 201, e.g., an internal combustion engine. The primary power source 201 is typically a dedicated power source, i.e., it is not used for transportation but only for the in-track welding energizing system 200. However, in an alternative embodiment, the primary power source 201 may also be used for functions outside of the in-track welding energizing system 200.

The primary power source 201 provides rotational energy to drive a generator 202. When thus driven, the generator 202 provides an alternating current (AC) electrical power output consistent with its construction. For example, in an embodiment, the generator 202 provides a 3-phase high-voltage (480V) AC output. The AC output of the generator 202 is first processed by a phase/transformer module 203, e.g., an SCR bridge comprising SCRs and diodes, into a single phase high voltage (e.g., 550V) high frequency (e.g., 1200 Hz) AC output.

The AC output of the phase/transformer module 203 is provided to and processed by a diode pack assembly 205. The diode pack assembly 205 comprises a transformer to step down the voltage of the input, as well as one or more rectifying circuit elements such as diodes to transform the signal from AC to DC. After this transformation, the output of the diode pack assembly 205 is a low voltage DC power signal. In an embodiment, the output of the diode pack assembly 205 has an open-circuit voltage between about 5 and about 12 volts, e.g., 8 volts. The current output by the diode pack assembly 205 may be as high as approximately 30,000 amps or higher.

During an in-track weld, the DC output of the diode pack assembly 205 is applied to a junction between rail segments, e.g., first rail segment 100 and second rail segment 101, to heat the junction and the surrounding material, in order to clean the rail ends, e.g., first rail end 106 and second rail end 107, and to perform the welding operation.

When the low-voltage high-current signal is passed through the rail junction, the primary heating modality is electrical resistance. In particular, when a high electrical current is passed through a conductive material, heat will be developed in the material as a function of the electrical resistance of the material. The primary heating affect will occur at the point or points of greatest resistance, which will be between the rail ends. Moreover, as the rail ends heat up, they become more resistive, increasing the spatial nonlinearity of the heating effect. The net result of these phenomena is to concentrate the heating of the rail material strongly as a function of cross-sectional area.

The primary power source 201 also drives a hydraulic source pump 204 to provide pressurized hydraulic fluid to the system. The pressurized hydraulic fluid is used for the operations of the welding head that require motion, such as moving the rails and shearing the weld joint.

At the initiation of a weld cycle, the rail ends of interest are brought together until they touch, as determined by the presence of a weld current draw. After contact, an amount of material, e.g., 0.25 inches, is removed from the two rail ends during what is referred to as a "burn off" stage. This step aids in the elimination of oxidation, grease, and other contaminants between the rail ends, and also serves to square uneven saw cuts so that the rail ends may be heated evenly.

Once the ends are square, the process of heating for welding begins in the heat flash stage, referred to as "flashing." During the flashing process, the rail ends are moved toward each other at a slow rate. The welding current is maintained at a level sufficient to melt and vaporize small areas of the rail ends that form contact points. This occurs in many places across the rail face at any given moment, forming a protective shield that prevents oxidation of the hot, reactive rail faces.

After flashing, a progressive flash stage begins. In this stage, an increase in the feed rate causes an increase in the number of contact points being melted and vaporized. The increase in metal vapor causes an increase in the protective shield that helps eliminate oxides from forming on the rail faces. At the same time, flashing crater depth is reduced, leaving less material to be forged away.

After the rail ends have been sufficiently heated and the surface cratering reduced by progressive flashing, the rails are forged at a high feed rate. The welding current may be left energized for some period of time, e.g., 1.5 seconds, after the start of this stage. This helps ensure that the hot rail surfaces are protected from oxidation immediately prior to forging.

Full forging force is applied to the rails for a predetermined period of time, e.g., nine (9) seconds, known as "holding time." The travel of the rails is stopped by the resistance of the heated rail ends, and as such the rail ends are forged together until there is no further plastic deformation. Experience has shown that a forging force of 9000 pounds per square inch exerted on the face of the two rail ends will yield favorable results. Thus, for example, the forging force required for 115# rail may be approximately 51 tons, while the forging force required for larger 141# rail may be about 63 tons.

During forging, oxides and liquid steel are expelled from the weld joint, typically resulting in a three-part weld burr. Two outer portions of the burr are formed by plastic deformation of soft material of the two rails, while a center portion is formed by metal expelled in a liquid state from the center of the weld joint.

After the weld is sufficiently firm but while the burr material is still hot, the welding head shears the burr from the weld joint. In an embodiment, the shear operation is executed by releasing one side of the rail, and then extending the welding head to a maximum open position. At this point, the extended side is re-clamped and the opposite side is unclamped. The welding head is then collapsed, i.e., the two sides are brought together, forcing a shear associated with the second side through the upset burr. Depending upon the rail section, the shearing operation may require as much as about 65 tons of force.

Figure 3:
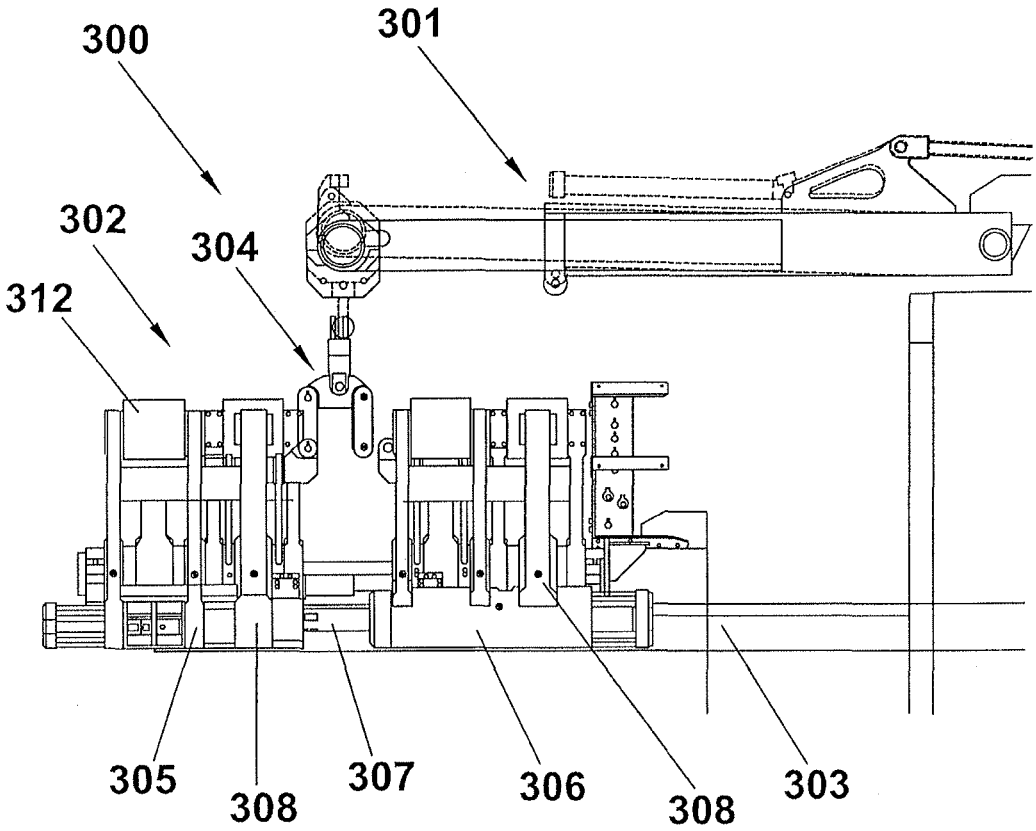
FIG. 3 is a plan view of a welding head system including a hoist and a welding head.

With the foregoing overview of the welding and shearing process in mind, the following description of the welding head may be more easily understood. A welding head system 300 according to the disclosure is illustrated in FIG. 3. In particular, FIG. 3 is a plan view of a welding head system 300 including a hoist 301 and a welding head 302. The hoist 301 may be attached to an on-track vehicle (not shown) riding on tracks, of which rail 303 may be seen, so that the welding head 302 may be controlled and positioned from the vehicle, and the welding head may be moved into or onto the vehicle between welding operations, e.g., during travel to or from a work site. The welding head 302 comprises a link 304 that is attached to a left head portion 305 and a right head portion 306. The hoist 301 is attached to the welding head 302 via the link 304.

In the view of FIG. 3, it can be seen that the left head portion 305 and the right head portion 306 are connected at track level via a force member 307. A matching force member, placed symmetrically across rail 303, also connects the left head portion 305 and the right head portion 306. These elements, which will be discussed in greater detail hereinafter, serve to draw the left head portion 305 and the right head portion 306 together, and with them any clamped rail segments in an aligned relationship.

Figure 4:
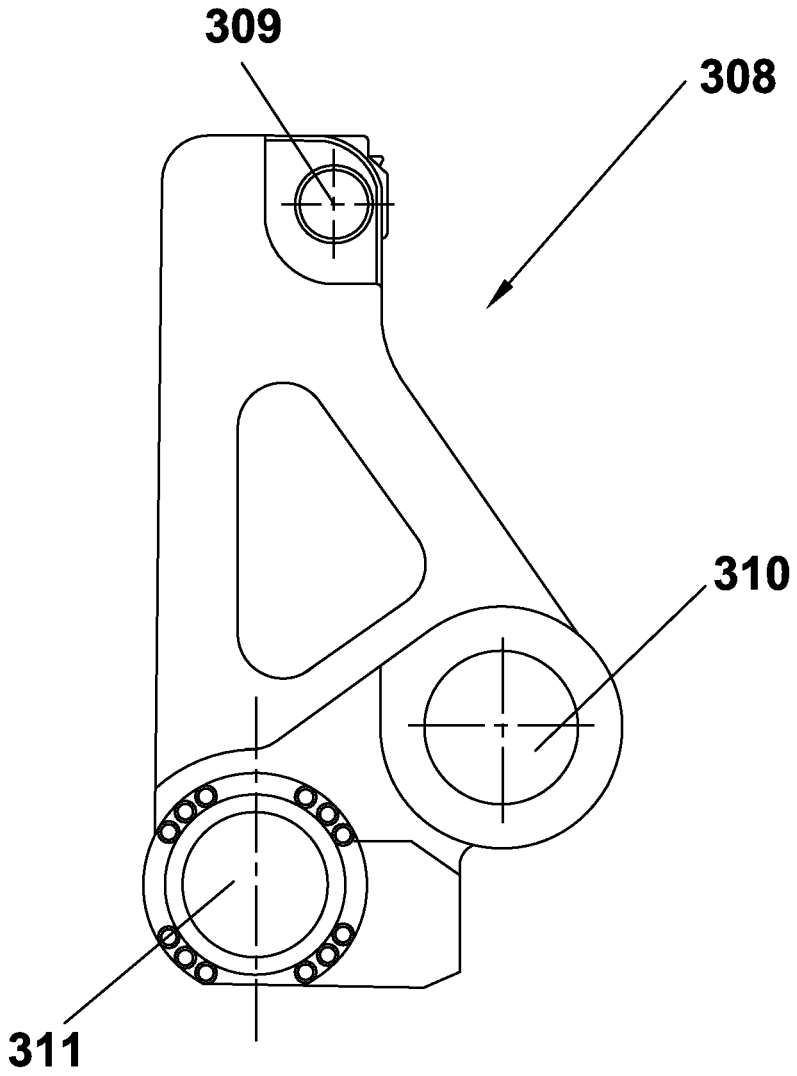
FIG. 4 is a plan view of a rail clamping arm.

The welding head 302 includes a number of rail clamping arms 308 that work in conjunction with mating arms to "pinch" the rail 303 with many tons of force. These elements will be described in greater detail with reference to FIGS. 3, 4 and 5. FIG. 4 is a plan view of a rail clamping arm 308. The rail clamping arm 308 includes three similar portions, the first of which is visible, the other two of which are identically oriented and are situated serially behind the first. Each portion includes a force pivot point 309 for receiving a hydraulic clamp actuator 312, a clamp arm pivot point 310 formed by an elongated through pin about which rail clamping arm 308 pivots, and a force member opening 311. The force member opening receives a casing linked to the force member 307. It will be appreciated that in one side of the head, e.g., the left head portion 305, the force member 307 is fixed within the force member opening 311, whereas in the other side, e.g., the right head portion 306, the force member is slidably associated within the force member opening 311 to be hydraulically actuated, thus enabling the welding head 302 to be compressed or extended in a controlled manner.

In operation, for each of the left head portion 305 and the right head portion 306, two similar clamp arms 308 are joined via an elongated through pin at the clamp arm pivot point 310. One or more hydraulic clamp actuators 312 extend between opposed force pivot points 309 of the joined clamp arms 308. As a hydraulic clamp actuator 312 extends, it forces the opposed force pivot points 309 apart. However, because the joined clamp arms 308 are constrained to pivot about the clamp arm pivot point 310, this forces the opposite ends of the joined clamp arms 308 together onto the rail, not shown. Once the opposite ends of the joined clamp arms 308 are clamped onto the rail for the left head portion 305 and the right head portion 306, any relative motion of the two weld head portions under the control of the force member 307 will move the clamped rails together or apart.

Figure 5:
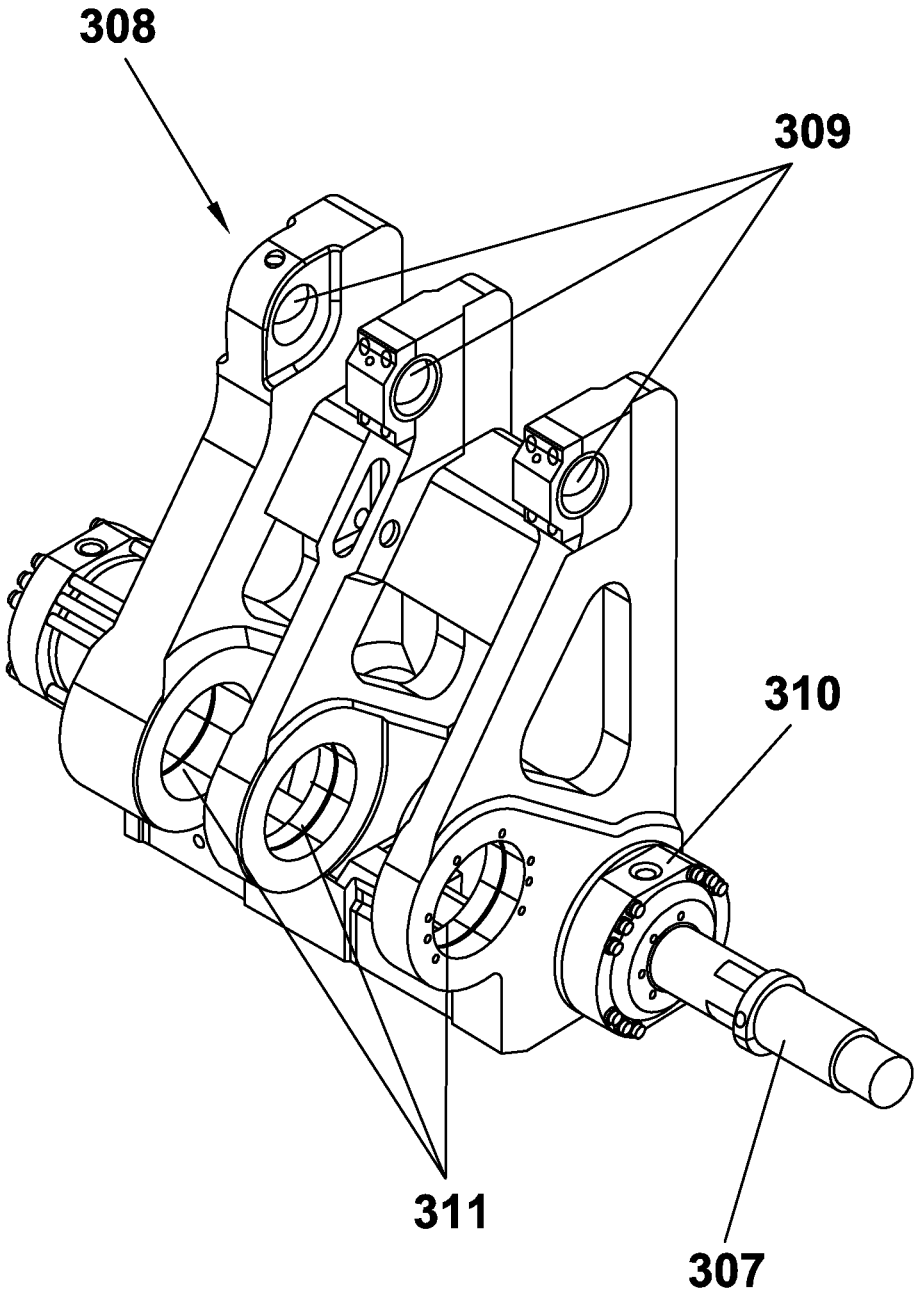
FIG. 5 is a perspective view of a rail clamping arm.

FIG. 5 is a perspective view of the rail clamping arm 308. In the view of FIG. 5, all three portions of the rail clamping arm 308 are visible. The force pivot point 309, clamp arm pivot point 310, and a force member opening 311 are also visible. The force member 307 is also shown.

Figure 6:
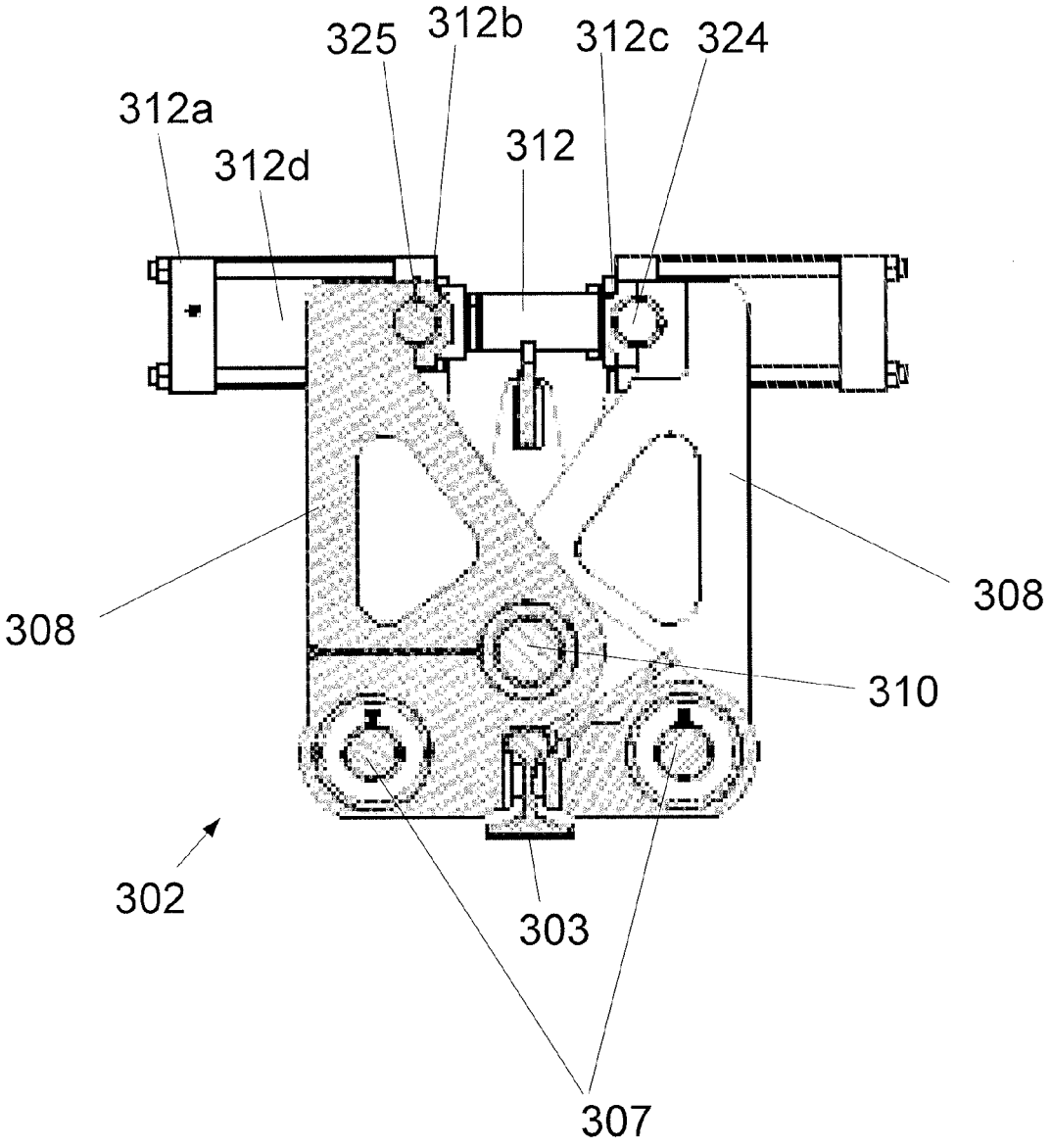
FIG. 6 is a cross-sectional view of a welding head constructed in accordance with the disclosed principles.

FIG. 6 is a cross-sectional view of the welding head 302 in accordance with the disclosure. In the view of FIG. 6 two rail clamping arms 308 are shown. The illustrated hydraulic clamp actuator 312 is in a fully extended position, pivoting the rail clamping arms 308 about the clamp arm pivot point 310, clamping rail 303 between the opposite ends of the rail clamping arms 308. The force members 307 are visible in end view.

The attachment of the hydraulic clamp actuator 312 to the rail clamping arms 308 is configured so as to maximize the portion of the force generated by the clamp actuator 312 which is transformed into clamping force applied to the rail 303. In particular, the clamping arm 308 must be able to pivot away from the rail 303 a sufficient distance to allow the welding head 302 to be applied to and removed from the rail 303. However, if typical hydraulic attachment were to be used, i.e., with a trunnion at the cap end 312*a* of the cylinder 312*d* and a trunnion at the rod end 312*c*, then the clamping arms 308 would be past vertical during clamping, and in such a position, too much of the force created by clamp actuator 312 would be wasted stretching the clamping arm 308 rather than clamping the rail 303.

In the illustrated example, the hydraulic clamp actuator 312 is attached to one clamping arm 308 via trunnion 324 on the clamping arm at the rod end 312*c* (having a clevis for engaging the corresponding trunnion 324) of the hydraulic clamp actuator 312 in the traditional manner. Multiple instances of the joint created by the clevis on the hydraulic clamp actuator 312 and the trunnion 324 on the one clamping arm 308 can be seen in an alternative view provided in FIG. 9. However, in this example the hydraulic clamp actuator 312 is attached to the other clamping arm 308 via a trunnion 325 at the rod end 312*b* of the hydraulic clamp actuator 312. In this way, when the welding head 302 is clamped on the rail 303, the clamping arm 308 is substantially vertical, but there is still sufficient range of motion to open the clamping arm 308 enough to clear the rail 303. This arrangement provides an increase in clamping force of approximately 15% over the traditional arrangement described above without any increase in the force generated by hydraulic clamp actuator 312.

Figure 7:
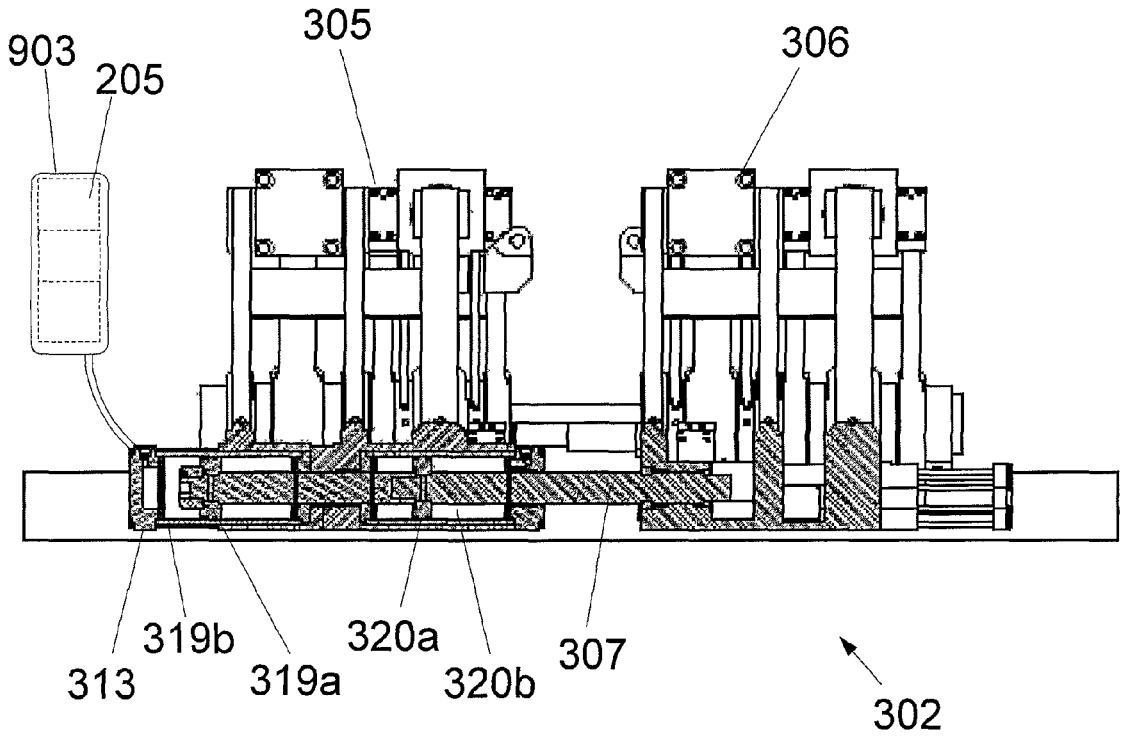
FIG. 7 is a cross-sectional view of the welding head in accordance with the disclosed principles showing the force member and its environment in greater detail.

The cross-sectional view of FIG. 7 shows the force member 307 and its environment in greater detail. In the illustrated arrangement, the force member 307 is fixed within the right head portion 306. However, the force member 307 is slidably associated with a hydraulic actuator 313 in the left head portion 305. In this manner, selective pressurization of the hydraulic actuator 313 can be used to move the right head portion 306 and the left head portion 305 relative to one another.

As previously noted, it is important to clamp the rails in the right location (in a central portion of the web) and to have the force members situated in line with this location. As such, it is desirable to place each hydraulic actuator 313 as close to the ground as possible. To this end, in an implementation, the diameter of each hydraulic actuator 313 is minimized and each hydraulic actuator 313 includes two axially aligned pistons and cylinders to approximately double the effective area that the hydraulic fluid acts upon, and thus to compensate for the smaller actuator diameter. In one implementation, a piston diameter of approximately 7.0" is used.

In the illustrated implementation, the hydraulic actuator 313 includes a first piston 319*a* within a first chamber 319*b* and a second piston 320*a* within a second chamber 320*b*. The first piston 319*a* and the second piston 320*a* are both linked inline to force member 307, so that the force applied to the force member 307 is approximately double what would ordinarily be expected an actuator of its dimensions.

Figure 8:
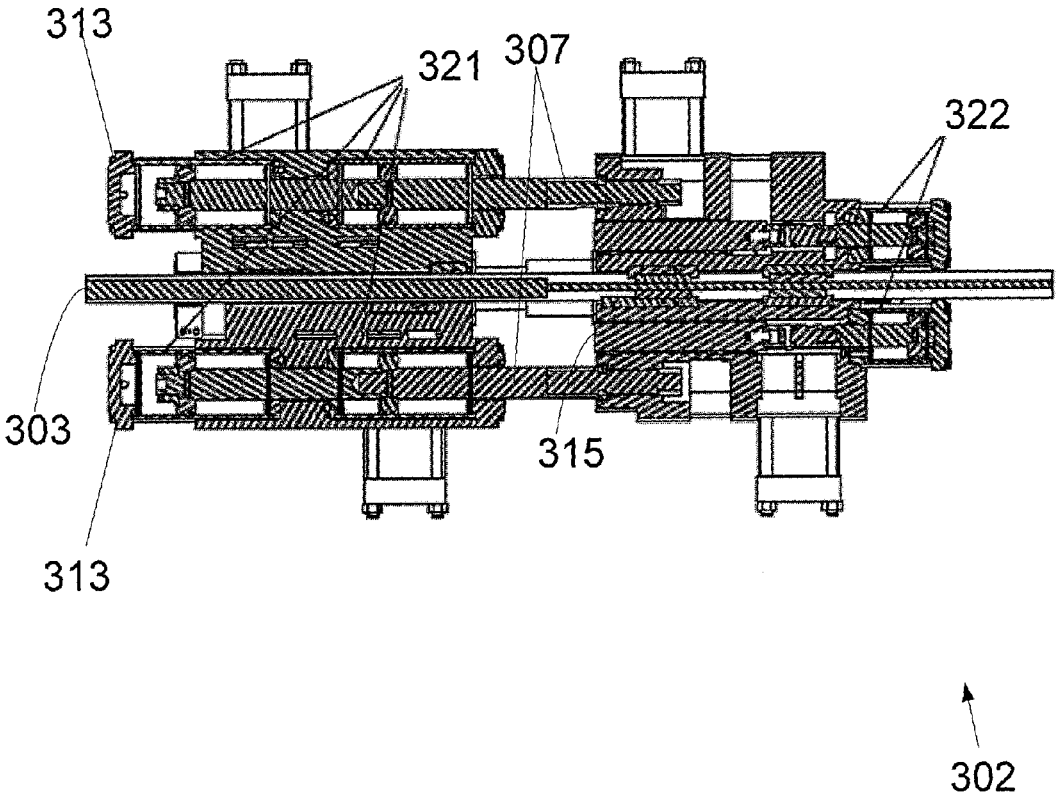
FIG. 8 is a cross-sectional bottom view of the welding head in accordance with the disclosed principles showing hydraulic actuators on each side of the welding head.

FIG. 8 is a cross-sectional bottom view of the welding head 302, showing a hydraulic actuator 313 on each side of the welding head 302. As noted with respect to FIG. 7, each hydraulic actuator 313 includes a first piston 319*a* within a first chamber 319*b* in tandem with a second piston 320*a* within a second chamber 320*b*, so that there are a total four piston assemblies 321 associated with the force members 307, with two such assemblies being associated with each force member 307. Although each hydraulic actuator 313 is shown with two piston assemblies 321 in tandem, it will be appreciated that the welding head 302 may alternatively be constructed with a single piston assembly 321 in each hydraulic actuator 313, or with three or more piston assemblies 321 in tandem in each hydraulic actuator 313. With the disclosed arrangement, closure forces of 180 tons or greater may be produced over a stroke length of six inches or more.

Figure 9:
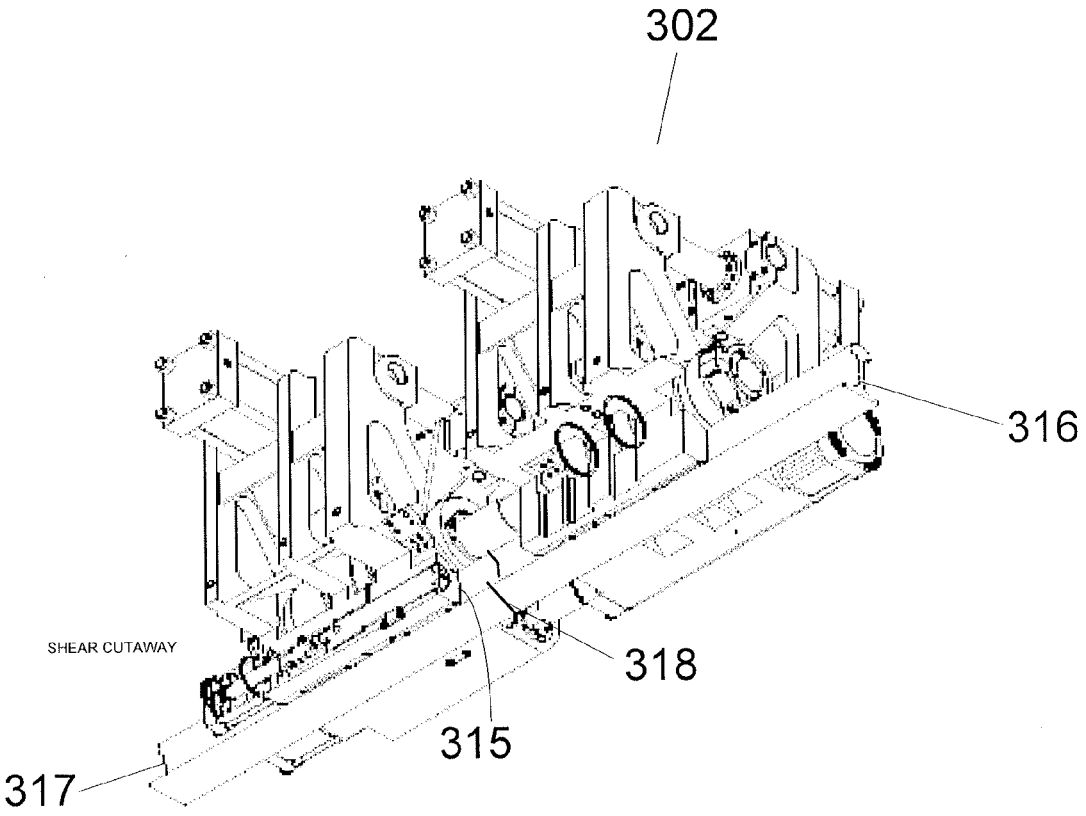
FIG. 9 is a cut away perspective view showing an internal shear associated with a head portion.

As noted above, forge welding of rail segments creates a weld burr that must be removed from the weld at some point prior to use of the rail way. In an embodiment of the invention, the weld head 302 includes an internal shear 315, as shown in FIG. 9, associated with one side of the weld head 302, and disposed inward of the clamping points of both the right head portion 306 and the left head portion 305. The long stroke length allowed by the DC operation of the weld head 302 allows the clamping points of the right head portion 306 and the left head portion 305 to be placed sufficiently far apart that the internal shear 315 may be conveniently placed between them.

The bottom cross-sectional view of FIG. 8 also shows the internal shear 315. In this view, it can be seen that the internal shear 315 includes a cutting surface on both sides of the rail 303. The internal shear 315 is driven by two shear piston assemblies 322 located inward of the respective force members 307. To execute a shearing operation, the shear piston assemblies 322 force the internal shear 315 over the joint 318 (see FIG. 9) between a first rail segment 316 and a second rail segment 317, removing any weld burr. The shearing operation is performed while the rail segments remain clamped, to avoid tearing or pulling within the joint 318 itself.

Figure 10:
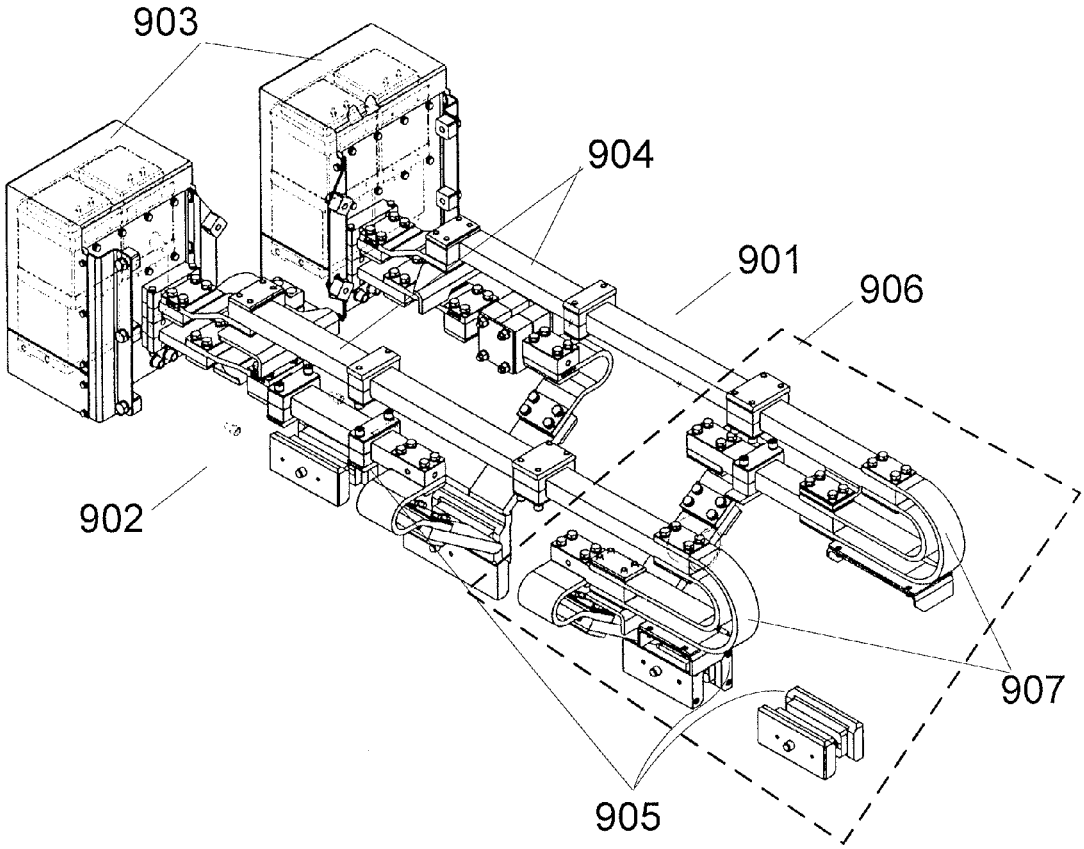
FIG. 10 is a perspective view of the conductive path members of the weld head.

As noted above, in accordance with the disclosure, the force member 307 need not be highly conductive, since it is not used as a conductor in the weld circuit. Rather, because of the DC operation and the resultant lack of inductive leakage, the weld current path may be constructed independently of high-conductivity material chosen for its electrical rather than structural properties. FIG. 10 is a perspective view of the conductive path members of the weld head 302. There are two separate conduction paths in the illustrated embodiment. In particular, a first conduction path 901 is associated with one side of the rail clamp and a second conduction path 902 is associated with the other side of the rail clamp. Each of conduction path 901 and conduction path 902 includes a diode pack assembly 205 for providing DC power to the circuit. The diode pack assemblies 205 are housed in electrical housings 903 located externally on the welding head 302 in an easily accessible location above and away from the welding location. One of the electrical housings 903 and diode pack assemblies 205 is also visible in FIG. 7. Not only is the illustrated location easily reached, but it is also accessible without removing any major components of the welding head 302. In this way, maintenance tasks will be more easily and safely undertaken, thus encouraging proactive maintenance and repair of the head 302.

A bus bar 904 in each circuit distributes power from the diode pack assembly 205 to the contact pads 905. Because portions of the circuit must be movable with respect to other portions of the circuit to enable the rails to be brought closer together during a weld operation, a circuit portion 906 is connected to the bus bar 904 via flexible conductive copper straps 907.

INDUSTRIAL APPLICABILITY

The present disclosure is applicable to systems for in-track welding of rail segments and provides an improved system wherein in-track welding is executed via DC power rather than AC power. As a result of this improvement, inductive power leakage is largely eliminated and separate weld circuit conductors of a convenient length and material may be used. As well, the force members 307 of the welding head 302 need not be optimized for conduction, and so may be constructed of a material optimized for strength, such as steel. In an embodiment, the force members 307 are constructed of 4140 stress proof steel and the structure of the welding head 302 near the welding location may be T1 plate. In this way, the force members 307 and other elements may be made smaller, stronger, and/or less expensive than in prior systems. For example, in an implementation, the force members 307 comprise 3.5" diameter alloy steel.

Moreover, because only resistive losses are of interest with respect to the DC power supply, the length of the weld circuit is not critical. This results in a longer allowed path and a longer possible stroke of the weld head 302. In an embodiment, the weld head 302 stroke is at least six inches and is as great as, or greater than, twelve inches. The increased allowed circuit length also allows the placement of an internal shear member 315 between contact pads 905 on opposite sides of the joint 318 without power leakage, so that the shearing process may be conveniently executed without completely removing the weld head 302 from the rail 303 under process.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An improved in-track weld system for forge welding of rail segments together in place on a rail way, the improved in-track weld system comprising:

a first set of two clamp arms pivotably connected at a first pivot point, and connected by a first hydraulic actuator, the first hydraulic actuator configured to actuate and cause the first set of two clamp arms to grasp a first rail segment;

a second set of two clamp arms pivotably connected at a second pivot point, and connected by a second hydraulic actuator, the second hydraulic actuator configured to actuate and cause the second set of two clamp arms to grasp a second rail segment, the second rail segment to be substantially axially disposed with respect to the first rail segment;

at least two hydraulically actuated force members linking the first set of two clamp arms clamping assembly and the second set of two clamp arms clamping assembly, wherein the force members are configured to provide a pulling force over a range of relative movement between the first set of clamp arms and the second set of clamp arms of greater than or equal to six inches, and with a maximum pulling force of 180 tons or greater; and a welding device configured to weld the first rail segment and second rail segment together.

2. The improved in-track weld system of claim 1, further comprising a weld circuit, separate from the force members, for applying a DC power differential across the first rail segment and the second rail segment, such that the weld circuit is closed when the first rail segment and the second rail segment are brought into contact, resulting in resistive heating of ends of the first rail segment and the second rail segment at a weld joint thereby enabling forging the rail ends together under the pulling force applied by the force members.

3. The improved in-track weld system according to claim 2, wherein the first hydraulic actuator has a primary axis that is substantially perpendicular to the first set of clamp arms attached thereto when the first hydraulic actuator is fully extended; and the second hydraulic actuator has a primary axis that is substantially perpendicular to the second set of two clamp arms attached thereto when the second hydraulic actuator is fully extended.

4. The improved in-track weld system according to claim 3, wherein each one of the first hydraulic actuator and the second hydraulic actuator has a cylinder and a rod, wherein the rod enters the cylinder at a cap end of the cylinder, and an opposite end of the rod supports a clevis connected to one clamp arm, and wherein the cap end of each cylinder includes a trunnion pivotably attached to another clamp arm.

5. The improved in-track weld system of claim 1, wherein each of the at least two hydraulically actuated force members is actuated via two in-line axially aligned hydraulically driven pistons.

6. The improved in-track weld system according to claim 5, wherein the force members are constructed of 4140 steel.

7. The improved in-track weld system according to claim 1, wherein a weld circuit includes a flexible member for allowing a stroke of the force members of greater than six inches.

8. The improved in-track weld system according to claim 7, wherein the flexible member comprises primarily flexible copper straps.

9. The improved in-track weld system according to claim 1, further comprising an internal shear assembly located between the first set of two clamp arms and the second set of two clamp arms, the internal shear assembly being operable to draw a shear member across a weld joint to remove a welding burr from the weld joint while the first and second sets of two clamp arms grasp the first and second rail segments.

10. The improved in-track weld system according to claim 9, wherein the internal shear assembly includes at least two actuators for drawing the shear member across the weld joint.

11. An improved in-track weld system for forge welding of rail segments together in place on a rail way, the improved in-track weld system comprising:

at least two clamping assemblies, each clamping assembly comprising at least two clamp arms and a hydraulic actuator, such that a first clamping assembly is configured to clamp onto and causes grasping a first rail segment and a second clamping assembly is configured to clamp onto and causes grasping a second rail segment;

at least two force members linking the first clamping assembly and the second clamping assembly, wherein the force members are operable to force the first rail segment and the second rail segment together; and a weld circuit included in a welding device configured to weld the first rail segment and the second rail segment together, separate from the force members, for applying a DC power differential across the first rail segment and the second rail segment, such that when the first rail segment and the second rail segment are brought into contact the weld circuit is closed, resulting in resistive heating of ends of the first rail segment and the second rail segment at a weld joint so that during operation of the weld system the ends are forged together under force applied by the force members.

12. The improved in-track weld system according to claim 11, wherein the force members are constructed of steel.

13. The improved in-track weld system according to claim 12, wherein the force members are constructed of 4140 steel.

14. The improved in-track weld system according to claim 11, wherein the weld circuit includes a flexible member for allowing a stroke of the force members of greater than six inches.

15. The improved in-track weld system according to claim 11, further comprising an internal shear member to remove a welding burr from the weld joint.

16. The improved in-track weld system according to claim 11, wherein the weld circuit includes a diode pack assembly having therein a transformer and one or more rectifying circuit elements.

17. The improved in-track weld system according to claim 16, wherein the diode pack outputs a low voltage DC power signal with an open-circuit voltage between about 5 and about 12 volts.

18. An on-track vehicle comprising:

an in-track weld system for forge welding of rail segments together in place on a rail way, the improved in-track weld system comprising:

at least two clamping assemblies, each clamping assembly comprising at least two clamp arms and a hydraulic actuator, such that a first clamping assembly is configured to clamp onto and causes grasping a first rail segment and a second clamping assembly is configured to clamp onto and causes grasping a second rail segment;

at least two force members linking the first clamping assembly and the second clamping assembly, wherein the force members are operable to force the first rail segment and the second rail segment together; and a weld circuit included in a welding device configured to weld the first rail segment and the second rail segment together, the weld circuit separate from the force members, for applying a DC power differential across the first rail segment and the second rail segment, such that when the first rail segment and the second rail segment are brought into contact the weld circuit is closed, resulting in resistive heating of ends of the first rail segment and the second rail segment at a weld joint so that during operation of the weld system the ends are forged together under force applied by the force members;

a generator within the vehicle for driving the weld circuit;

an engine within the vehicle for driving the generator; and a hoist for placing the in-track weld system on a track to be welded.

19. The on-track vehicle according to claim 18, wherein the weld circuit includes a flexible member for allowing a stroke of the force members of greater than six inches.

20. The on-track vehicle according to claim 18, wherein the in-track weld system comprises a shear member that is operable to remove a welding burr from the weld joint while the at least two clamping assemblies are clamped.

* * * * *